US006311033B1

(12) United States Patent
Wen et al.

(10) Patent No.: US 6,311,033 B1
(45) **Date of Patent: *Oct. 30, 2001**

(54) ELECTROPHOTOGRAPHIC EXPOSURE AND DEVELOPMENT ARRANGEMENT

(75) Inventors: Jian Wen, Irvine; Hazen Hoyt, III, Costa Mesa, both of CA (US)

(73) Assignee: Aetas Technology Corporation, Irvine, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/503,098

(22) Filed: Feb. 11, 2000

(51) Int. Cl.[7] ..... G03G 15/00
(52) U.S. Cl. ..... 399/164; 399/177
(58) Field of Search ..... 399/113, 118, 399/152, 159, 162, 164, 177, 220; 347/118, 138, 238, 256

(56) References Cited

U.S. PATENT DOCUMENTS 4,893,926 1/1990 Willis .
5,272,508 * 12/1993 Sakakibara et al. ..... 399/159
5,291,246 * 3/1994 Tsukamoto ..... 347/138 X
5,552,863 9/1996 Genovese .
5,557,377 9/1996 Loewen .
5,608,498 * 3/1997 Nagase et al. ..... 347/138 X
5,612,767 3/1997 Iwama .
5,697,025 * 12/1997 Tokimatsu et al. ..... 399/159
5,752,137 5/1998 Haneda .
6,041,204 * 3/2000 Haneda et al. ..... 399/159

* cited by examiner

*Primary Examiner*—Sandra Brase
(74) *Attorney, Agent, or Firm*—BakerBotts, LLP

(57) ABSTRACT

In the embodiment disclosed in the specification, an electrophotographic exposure and development arrangement has a flexible transparent photoreceptor belt driven between two support rollers and along four printing stations at each of which the photosensitive surface of the photoreceptor is charged, exposed to a light image corresponding to a selected color, and developed with toner of the corresponding color to produce a composite multicolor image which is transferred to a substrate and subsequently fixed on the substrate. At each printing station an exposure unit has a curved belt support surface which is engaged by the photoreceptor belt passing through the printing station between the exposure location and a development location with a curvature and length selected to minimize the effect of ripples or irregularities in the position of the photosensitive surface of the photoreceptive belt resulting from a set taken by the photoreceptor belt when held stationery against a supporting number.

14 Claims, 2 Drawing Sheets

ELECTROPHOTOGRAPHIC EXPOSURE AND DEVELOPMENT ARRANGEMENT

BACKGROUND OF THE INVENTION

This invention relates to electrophotographic systems utilizing a flexible transparent photoreceptor belt having an image exposure unit on one side of the transparent belt and an image development unit on the opposite side of the transparent belt.

In electrophotographic systems utilizing a flexible photoreceptor belt driven in a continuous path past a series of printing stations having exposure units and development units, the light-emitting elements of the exposure units are focused on the light sensitive surface of the photoreceptor so that the light emitted by each light-emitting element forms a single dot of an image on the photo sensitive surface of the photoreceptor. Because the light converges inwardly toward the image point, variations in the position of the photoreceptor with respect to the light-emitting element can cause blurring or otherwise interfere with the quality of the image. Consequently, a precise spacing must be maintained between the array of light-emitting elements in the image exposure unit and the light sensitive surface of the photoreceptor. In electrophotographic systems in which the photoreceptor is a flexible belt such as one made of organic polymer material there are problems with maintaining a precise set distance between the light-emitting array and the photo sensitive surface of the flexible organic polymer photoreceptor belt which tends to take a set and form a ripple in any portions which are in contact with support members such as drive rollers and the supports for the light emitting arrays when the belt is maintained in a stationary position for any significant period of time.

Attempts have been made to alleviate this problem by mounting the light emitting diode arrays in different ways. For example, U.S. Pat. No. 4,893,926 discloses a correction device which alters the position of the light exposure unit relative to the image holding member so as to allow flexibility in the spacing between the light-emitting elements of the exposure unit and the photoreceptor surface. In another arrangement, disclosed in U.S. Pat. No. 5,612,767, a correction member is provided which changes the position of the light exposure unit with respect to the image holding member, thereby permitting the position of the light exposure unit to be set with respect to the image receiving member.

Japanese Patent No. 2912258 discloses an electrophotographic apparatus in which a flexible photoreceptor in the form of an endless transparent belt having a photosensitive surface driven around a plurality of rollers is guided along cover glasses which engage the belt on one side. Light-emitting diode arrays mounted behind the cover glasses expose the sensitive surface of the photoreceptor after charging to produce a latent electrostatic image, and a developing unit on the opposite side of the belt then develops the latent image. Each cover glass extends across two of the light-emitted diode arrays and provides a planar support surface for the photoreceptor belt at the exposure stations. Any portion of an organic polymer photoreceptor belt which has a ripple because it has taken a set by resting against a support member such as a roller for a period of time, however, cannot be held substantially flat by passing it along such a planar surface at an exposure station. This causes problems in focusing of the light from the diode arrays on the photosensitive surface of the belt The Haneda U.S. Pat. No. 5,752,137 also discloses an electrophotographic apparatus having a transparent flexible photoreceptor belt driven around a plurality of rollers which passes adjacent to a planar support member provided with exposure scanning slits through which image light from exposure units is transmitted to the photoreceptor.

The Genovese U.S. Pat. No. 5,552,863 discloses an electrophotographic apparatus utilizing a flexible transparent photoreceptor belt driven in an endless loop past a plurality of charging, exposure, and development stations in which the exposure stations focus exposure light through the photoreceptor belt to the photosensitive surface using transparent shoes which slidingly engage the surface of the photoreceptor belt so that the belt is bent at an angle as it passes along each shoe. The development stations are located on the opposite side of the belt in spaces between the exposure shoes where the belt is unsupported.

The prior art exposure and development arrangements do not overcome the problems caused by images formed by light-emitting elements focused on a rippled or changing surface such as an organic polymer photoreceptor belt which has developed a set as a result of resting against support members, or which is inadequately supported in the region in which the image is exposed or developed.

SUMMARY OF THE INVENTION

Accordingly it is an object to the present invention to provide an electrophotographic arrangement having a flexible transparent photoreceptor belt which overcomes disadvantages of the prior art.

Another object to the invention is to provide an electrophotographic arrangement which eliminates degradation of image quality resulting from variations in the position of the photoreceptor belt during exposure and development.

These and other objects of the invention are attained by providing an electrophotographic exposure and development arrangement utilizing a transparent flexible photoreceptor and an image exposure unit having a curved belt support surface which guides the transparent photoreceptor belt adjacent to the exposure unit to provide support for the photoreceptor belt in a desired position at the exposure station and also at an adjacent development station to assure optimum positioning of the belt during both image exposure and development. In a preferred embodiment the apparatus includes four printing stations each containing an exposure unit with a curved belt support surface extending adjacent to a development unit and producing successive images of different color so as to provide multicolor printing.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
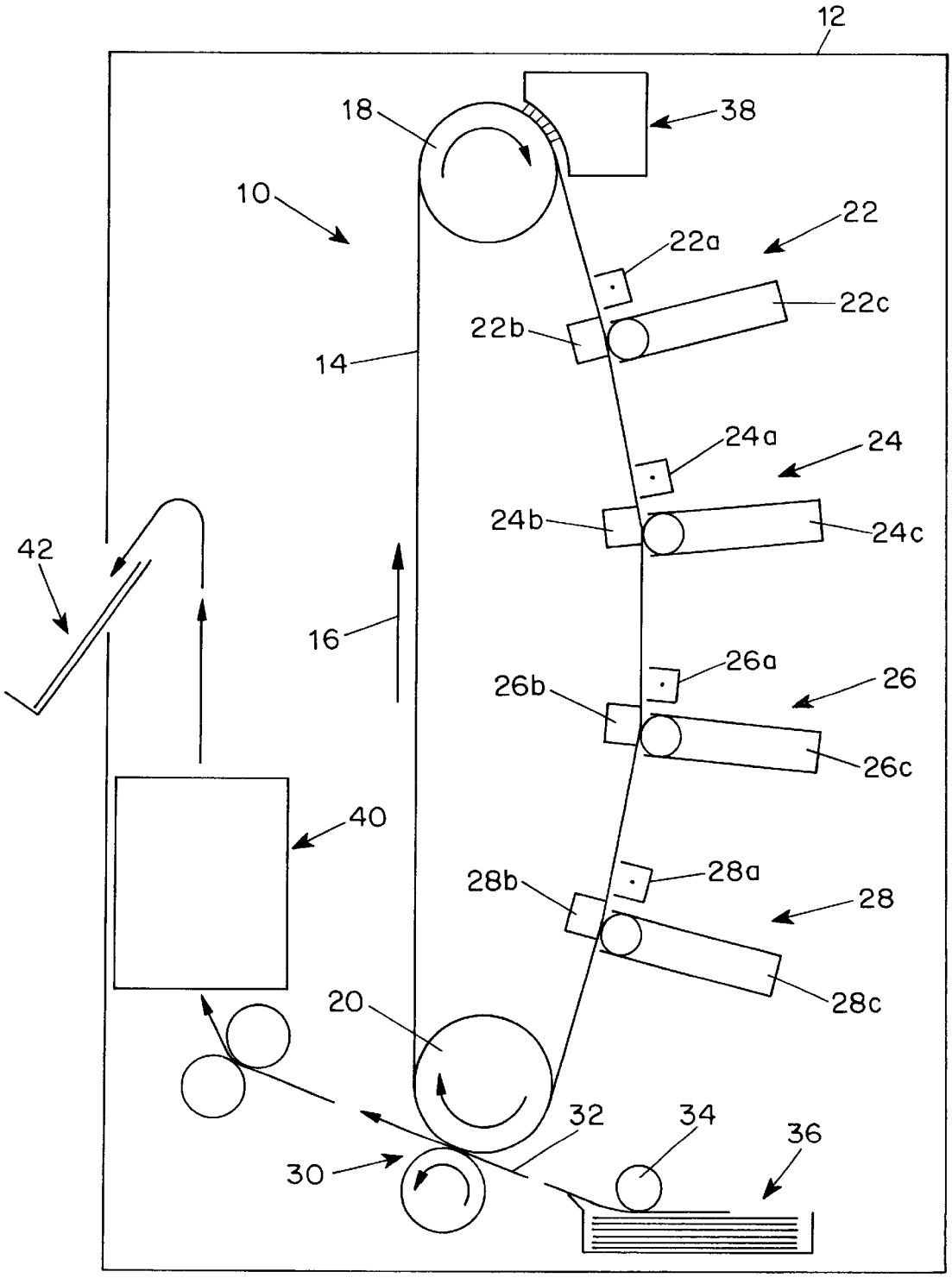
FIG. 1 is a schematic diagram illustrating the arrangement of a representative embodiment of an electrophotographic system in accordance with the invention.

In the typical embodiment of the invention shown in the drawings, an electrophotographic color printer 10 enclosed in a housing 12 has a flexible photoreceptor belt 14 which is driven in an endless path in the direction of the arrow 16 by two rollers 18 and 20. On one side of its endless path, the belt is driven past four successive printing stations 22, 24, 26 and 28 which produce four different colored images in superimposed relation on the outer surface of the belt. The belt then passes through a transfer station 30 at which the resulting multicolor image is transferred to a substrate sheet 32, which is withdrawn by a roller 34 from a supply tray 36. At the opposite end of the path of the belt 14, a cleaning unit 38 removes any residual developer from the surface of the belt prior to its next passage through the printing stations 22–28. Each substrate sheet 32 to which an image has been transferred is subsequently directed through a fuser unit 40 in which the image is fixed on the substrate in any conventional way and is then passed to an output tray 42.

The photoreceptor belt 14 has an outer photosensitive surface 62 which is capable of storing electrostatic charge in the dark and dissipating the charge on exposure to light and each of the printing stations 22, 24, 26 and 28 includes a corona charging unit 22*a*, 24*a*, 26*a*, and 28*a* adjacent to the outer surface 62 of the belt by which a uniform electrostatic charge is applied to that surface in the usual manner. An LED exposure unit 22*b*, 24*b*, 26*b* and 28*b* downstream of the charging unit and located on the opposite side of the photoreceptor belt has light-emitting diodes which are selectively actuated to project light corresponding to an image of one color through the transparent photoreceptor to discharge the electrostatic charge at appropriate locations on the opposite surface of the belt to produce an electrostatic charge image.

Figure 2:
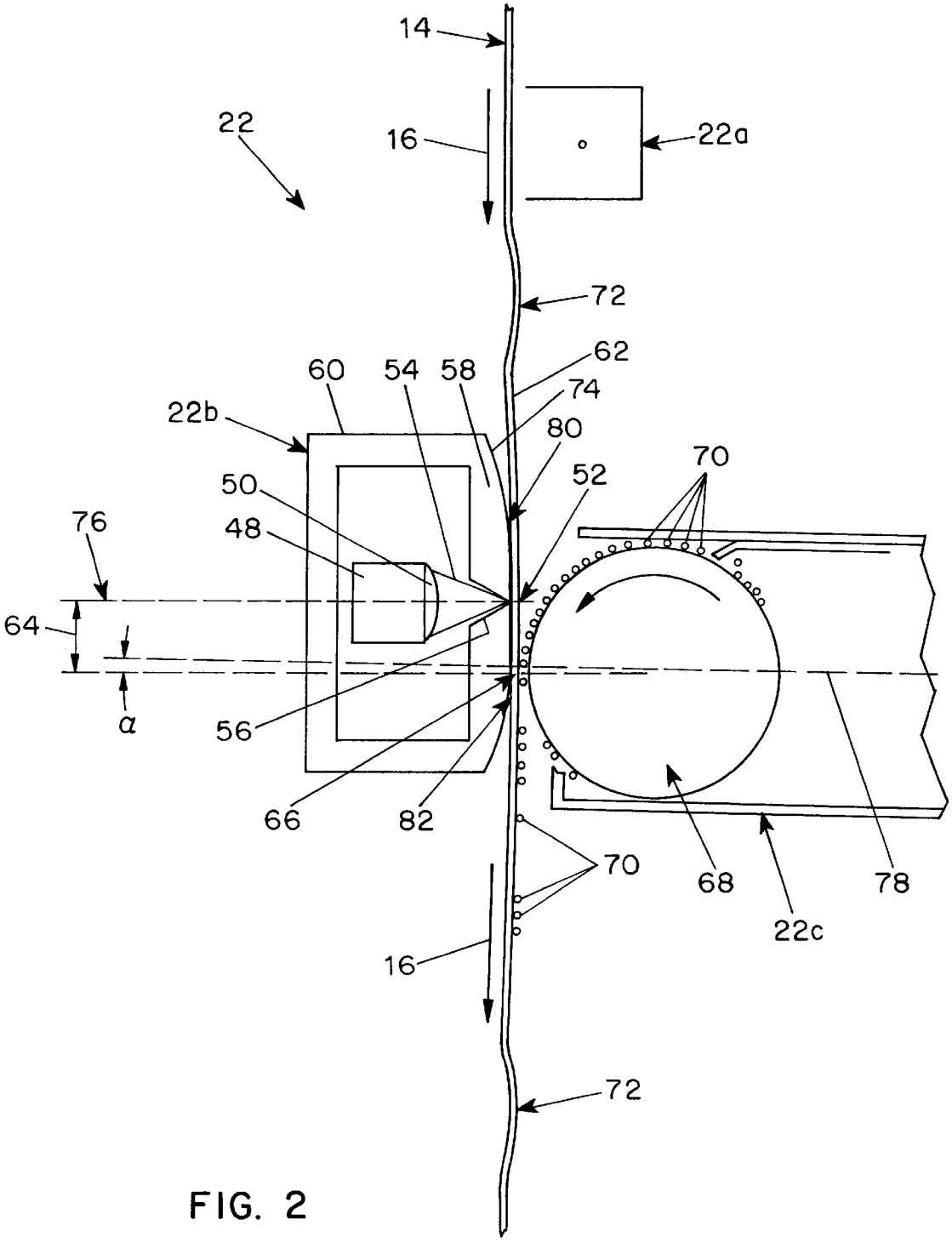
FIG. 2 is an enlarged fragmentary view illustrating the arrangement of one set of adjacent exposure and development stations in the embodiment of FIG. 1 in greater detail.

Downstream of the exposure unit each printing station includes a developing unit 22*c*, 24*c*, 26*c* and 28*c*, shown in greater detail in FIG. 2, which conveys developer of appropriate color corresponding to the intended color of the electrostatic charge image produced by the exposure unit adjacent to the surface of the photoreceptor so as to produce a visible image of the corresponding color on the photoreceptor surface 62 in the usual manner. In this way four successive different color images, for example yellow, magenta, cyan and black images, are superimposed on the photosensitive surface 62 of the photoreceptor belt to produce a composite multi-color image for subsequent transfer to the substrate sheet 32.

The photoreceptor belt 14, which is normally made of an organic polymer material tends to take a set when it is held stationary against support numbers such as the rollers 18 and 20 and the guiding surfaces of the exposure units 22*b*, 24*b*, 26*b* and 28*b*. As a result, when the belt is moved away from its stationary position, it will retain a surface configuration having ripples 72 at locations corresponding to the locations of the belt supports for a significant period of time. Such ripples 72 can not be completely removed or flattened by applying tension to the belt when it is passing through an unsupported region or along planar surface. Consequently, the spacing of the photosensitive surface 62 of the belt from the light-emitting diodes arrays and from the transfer roller of the developing unit will vary as the belt moves through the printing stations of conventional electrophotographic printers, causing irregularities in the exposure of the charged surface 64 to light by the exposure units and in the spacing of the surface containing the resulting charge image from a developer roller in the developing units, which results in degradation of the visible image produced during printing.

In order to overcome this problem in accordance with the invention, each of the printing stations 22, 24, 26 and 28 is arranged in the manner shown in FIG. 2, which is a fragmentary enlarged view illustrating the components 22*a*, 22*b*, and 22*c* of the printing station 22. As shown in FIG. 2, the LED array 22*b* contains a row of light-emitting diodes 48 extending perpendicular to the plane of FIG. 2, each producing a light output which is focused by a selfoc lens 50 substantially to a point 52 at the apex of a cone 54 which converges within a slot 56 in a front wall 58 of a housing 60 containing the light-emitting diodes. The diodes 48 and the cones 54 of light produced by the diodes are positioned so that the focal points of the row of diodes extend along a line at the point 52 on the outer photosensitive surface 62 of the photoreceptor 14 on which the electrostatic charges applied by the corona charging unit 22*a* are retained.

In response to the selective exposure of the layer 62 to light by the exposure unit 22*b*, the charges on the surface 62 are dissipated at the locations which have been exposed to produce an electrostatic charge image. Complete dissipation of the charges at those locations requires about 50 milliseconds, during which the photoreceptor belt travels a distance, designated 64, between the exposure location 52 and a development location 66 at which a development roller 68 in the developing unit 22*c* transfers developer 70 to the charged portion of the surface 62.

If the belt 14 is moving at a rate of about 50 millimeters per second in the direction indicated by the arrow 16, the distance during which the charge is dissipated in the exposed regions is about 2.5 mm. Consequently, if the distance 64 is at least 2.5 mm, substantially all of the charge in the exposed regions of the photosensitive layer has dissipated by the time the exposed part of the photoreceptor has reached the location 66, at which a transfer roller 68 transfers toner 70 to the surface 62 to develop the electrostatic image. Accordingly, the developer particles 70 on the surface of the transfer roller 68 are deposited on the surface 62 of the photoreceptor belt 14 in conformance with the electrostatic charge image produced on the photoreceptor.

In order to avoid the effect of any residual bumps or ripples 72 in the photoreceptive belt 14 caused by a set taken by the photoreceptor belt when held stationary against a supporting member, the outer surface 74 of the front wall 58 of the exposure unit 22*b* is formed with a slight curvature having approximately the same curvature as the ripples 72. For this purpose, the radius of curvature of the surface 74 is preferably in the range from about 50 mm to 500 mm, and desirably about 100 mm. With this curvature, a ripple 72 in the photoreceptor belt causes a minimal deviation of the surface 62 from the optimal position, for example no more than 40 $\mu$m, and preferably no more than about 20 $\mu$m, as it passes through the exposure location 52 and the development location 66. These variations in the position of the photosensitive layer on the surface 62 are well within the depth of focus of ±50 $\mu$m for the selfoc lens 50 for 600 dot per inch resolution, and also within a similar permissible range of variation in the spacing of the transfer roller 68 from the surface 62. That spacing is preferably from about 0.3 mm to about 0.8 mm, and desirably approximately 0.5 mm.

In order to optimize the exposure and development steps, the exposure should be effected in a plane 76 extending substantially perpendicular to the surface 62 at the exposure location 52 and the development unit 22*c* should be oriented so that a plane passing through the axis of the roller 68 is substantially perpendicular to the surface 62 at the development location 66. Since the surface 52 is curved between those points and the photoreceptor belt surface 62 will be correspondingly curved, the central plane 78 of the development unit 22*b*, which extends through the axis of the development roller 68 perpendicular to the surface 62 is disposed at an angle of approximately 1° to 2°, preferably about 1.5°, to the exposure plane 76 which extends through the exposure location 52 perpendicularly to the surface 62.

Preferably, the development roller 68 has a diameter in the range from about 15 mm to 30 mm and the distance 64 is the range from about 2 mm to about 10 mm, and desirably about 5 mm. Moreover, the total length of the curved belt support surface where it is in contact with the photoreceptor belt 14 from a point 80 where it first engages the surface 74 prior to the exposure plane 76 to a point 82 where it separates from the surface 74 after the development plane 78 is preferably in a range from about 5 mm to about 20 mm, and desirably in a range from about 10 mm to about 15 mm in order to minimize the effect of any ripples 72.

Thus, with this arrangement, the curved front surface 74 of the housing 60 for the light-emitting diode array 22*b* provides stable and accurate positioning of the surface 62 of the photoreceptor 14 both during exposure by the light-emitting diodes 48 and during transfer of toner 70 by the development roller 68, while at the same time substantially eliminating the effect of variations in the position of the photosensitive surface 62 of the photoreceptor belt 14 by ripples 72 at both the imaging and development positions so that high quality image reproduction is assured despite the presence of ripples 72 in the photoreceptor belt where it has taken a set.

Although the invention has been described herein with reference to specific embodiments, many modifications and variations therein will readily occur to those skilled in the art. Accordingly, all such variations and modifications are included within the intended scope of the invention.

We claim:

1. An electrophotographic exposure and development arrangement comprising an image exposure unit having a curved belt support surface for supporting a moving transparent flexible photoreceptor belt at an image position at which the belt is exposed to imaging light by the image exposure unit on one side and at a development position spaced in the direction of motion of the belt from the image exposure position and a development unit disposed in spaced relation to the curved belt support surface on the opposite side of the flexible photoreceptor belt for applying toner to an electrostatic charge image on an adjacent surface of the photoreceptor belt while it is supported by the curved surface.

2. An electrophotographic exposure and development arrangement according to claim 1 wherein the image exposure position and the development position are spaced by at least about 2.5 mm in the direction of motion of the photoreceptor belt.

3. An electrophotographic exposure and development arrangement according to claim 1 wherein the development unit includes a developer roller which has a diameter in a range of about 15 mm to 30 mm for transfer of toner to an adjacent surface of the photoreceptor belt.

4. An electrophotographic exposure and development arrangement according to claim 3 wherein the developer roller has a diameter of approximately 20 mm.

5. An electrophotographic exposure and development arrangement according to claim 1 wherein the development unit includes a developer roller which is spaced from an adjacent surface of the photoreceptor supported on the curved belt support surface by a spacing in the range from about 0.3 mm to about 0.8 mm.

6. An electrophotographic exposure and development arrangement according to claim 5 wherein the developer roller is spaced from the curved belt support surface by a spacing of about 0.5 mm.

7. An electrophotographic exposure and development arranged according to claim 1 wherein the spacing between the image exposure position and the development position is in the range from about 2 mm to about 10 mm.

8. An electrophotographic exposure and development arrangement according to claim 7 wherein the spacing between the image exposure position and the development position is about 5 mm.

9. An electrophotographic exposure and development arrangement according to claim 1 wherein the portion of the curved belt support surface which is in contact with the photoreceptor has a length in the direction of motion of the photoreceptor in the range from about 5 mm to about 20 mm.

10. An electrophotographic exposure and development arrangement according to claim 9 wherein the portion of the curved belt support surface which is in contact with the photoreceptor has a length in the direction of motion of the belt in a range from about 10 mm to about 15 mm.

11. An electrophotographic exposure and development arrangement according to claim 1 wherein a plane extending perpendicular to the curved belt support surface at the image exposure position extends at an angle in the range from about 1° to about 2° to a plane extending perpendicular to the curved belt support surface at the development position.

12. An electrophotographic exposure and development arrangement according to claim 11 wherein the angle between the plane perpendicular to the curved belt support surface at the image exposure position and a plane perpendicular to the curved belt support surface at the development position is about 1.5°.

13. An electrophotographic exposure and development arrangement according to claim 1 wherein the curved belt support surface has a radius of curvature in the range of about 50 mm to about 500 mm.

14. An electrophotographic exposure and development arrangement according to claim 13 wherein the radius of curvature of the curved belt support surface is about 100 mm.

* * * * *